US009820048B2

(12) United States Patent
Veeramani et al.

(10) Patent No.: US 9,820,048 B2
(45) Date of Patent: Nov. 14, 2017

(54) TECHNOLOGIES FOR LOCATION-DEPENDENT WIRELESS SPEAKER CONFIGURATION

(71) Applicant: Intel Corporation, Santa Clara, CA (US)

(72) Inventors: Karthik Veeramani, Hillsboro, OR (US); Krishnan Rajamani, San Diego, CA (US); Srikanth Kambhatla, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/998,306

(22) Filed: Dec. 26, 2015

(65) Prior Publication Data

US 2017/0188151 A1 Jun. 29, 2017

(51) Int. Cl.
*H04R 3/12* (2006.01)

(52) U.S. Cl.
CPC ..... *H04R 3/12* (2013.01); *H04R 2420/07* (2013.01)

(58) Field of Classification Search
CPC ..... H04R 3/12; H04R 2420/07
See application file for complete search history.

(56) References Cited

U.S. PATENT DOCUMENTS

2002/0159611 A1* 10/2002 Cromer ..... H04S 7/40 381/303
2008/0242228 A1* 10/2008 Saito ..... H04R 1/1091 455/41.2
2009/0003227 A1* 1/2009 Malomsoky ..... H04L 29/06027 370/252
2014/0146984 A1* 5/2014 Kim ..... H04R 5/00 381/307
2014/0270282 A1* 9/2014 Tammi ..... H04R 5/02 381/300
2015/0256954 A1* 9/2015 Carlsson ..... H04R 27/00 381/59
2015/0264506 A1* 9/2015 Balabanis ..... G01S 5/02 381/303
2016/0057537 A1* 2/2016 Robinson ..... H04R 5/04 381/77
2016/0309277 A1* 10/2016 Hiscock ..... H04S 7/301

* cited by examiner

*Primary Examiner* — Mark Fischer
(74) *Attorney, Agent, or Firm* — Barnes & Thornburg LLP

(57) ABSTRACT

Technologies for location-dependent wireless speaker configuration include a mobile computing device wirelessly coupled to a plurality of speakers. The mobile computing device is configured to determine a location of and assign a location indicator to each of the speakers based on the determined locations. The location indicator identifies a location of each speaker relative to the other speakers such that the mobile computing device can generate an audio stream for each of the speakers based on the assigned location indicator and transmit each of the generated audio streams to a corresponding one of the speakers. Other embodiments are described and claimed herein.

19 Claims, 6 Drawing Sheets

TECHNOLOGIES FOR LOCATION-DEPENDENT WIRELESS SPEAKER CONFIGURATION

BACKGROUND

Traditionally, surround sound speaker systems include an audio/video receiver (AVR) that supports two or more speakers that may be connected in various wired and/or wireless configurations. The AVR typically receives a single stream of audio from a transmitting device (e.g., a smartphone, a laptop, etc.) that includes data for multiple audio channels. Upon receiving the audio stream, the AVR decodes each channel's data and routes the data to the appropriate speaker for output by the receiving speaker. However, advancements in computing technologies have resulted in smaller, cheaper, and more powerful components capable of being embedded in the speakers themselves. In turn, more intelligent, independent speakers have been developed that can accept a single-channel audio stream directly from a transmitting device wirelessly coupled to the speaker.

BRIEF DESCRIPTION OF THE DRAWINGS

The concepts described herein are illustrated by way of example and not by way of limitation in the accompanying figures. For simplicity and clarity of illustration, elements illustrated in the figures are not necessarily drawn to scale. Where considered appropriate, reference labels have been repeated among the figures to indicate corresponding or analogous elements.

DETAILED DESCRIPTION OF THE DRAWINGS

Figure 1:
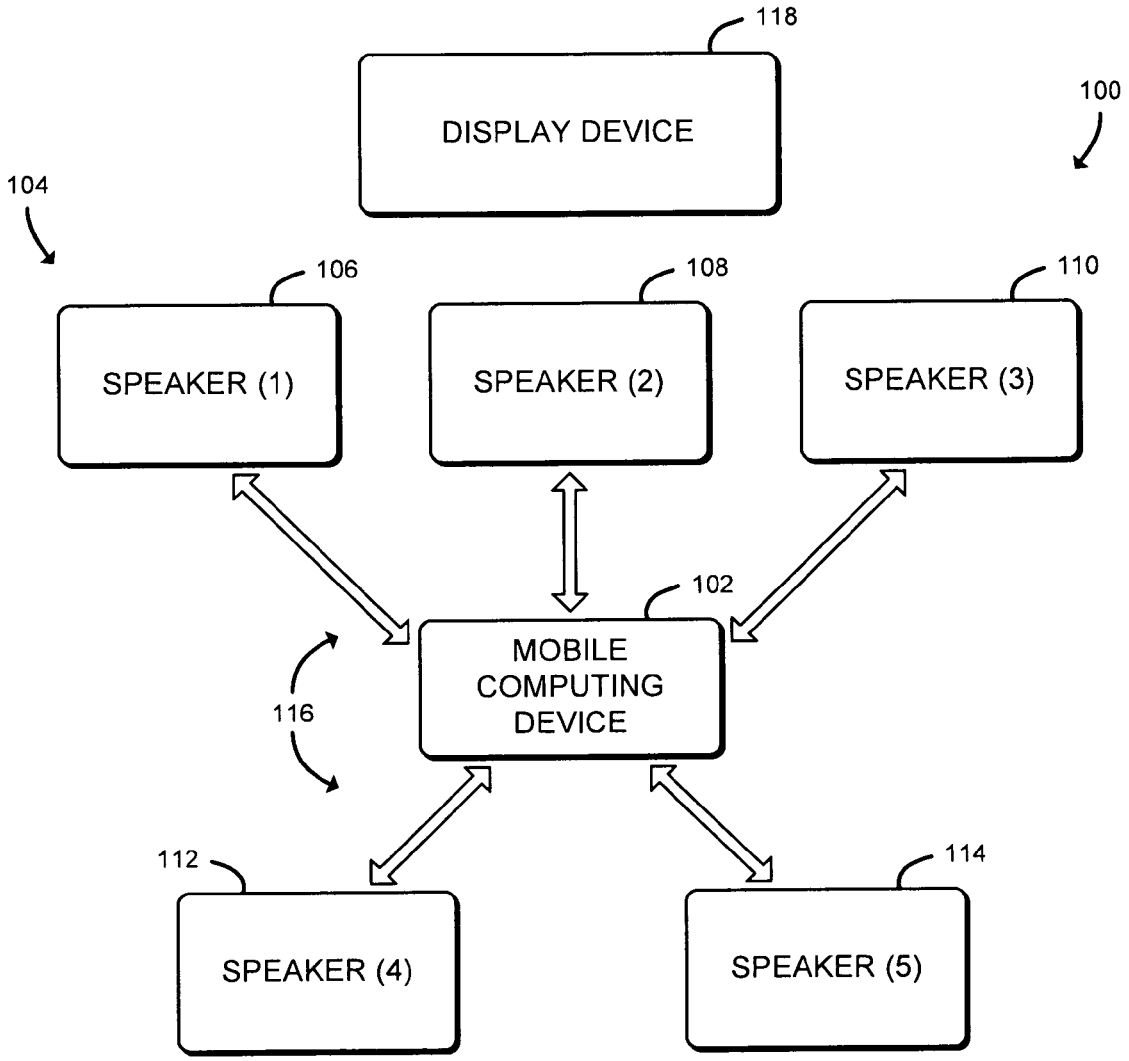
FIG. 1 is a simplified block diagram of at least one embodiment of a system for location-dependent wireless speaker configuration that includes a mobile computing device wirelessly coupled to a plurality of speakers.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. Additionally, it should be appreciated that items included in a list in the form of "at least one of A, B, and C" can mean (A); (B); (C); (A and B); (A and C); (B and C); or (A, B, and C). Similarly, items listed in the form of "at least one of A, B, or C" can mean (A); (B); (C); (A and B); (A and C); (B and C); or (A, B, and C).

The disclosed embodiments may be implemented, in some cases, in hardware, firmware, software, or any combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

Referring now to FIG. 1, in an illustrative embodiment, a system 100 for location-dependent wireless speaker configuration includes a mobile computing device 102 wirelessly coupled to multiple speakers 104 via wireless communication channels 116. In use, the mobile computing device 102 detects a location of each of the speakers 104 (e.g., using an angle of incidence detector) relative to the mobile computing device 102 and the other speakers 104. Upon determining the location of each of the speakers 104, the mobile computing device 102 assigns a location indicator (i.e., a location designation) to each speaker, which is usable by the mobile computing device 102 to split each audio stream channel of a single multi-channel audio stream and route to each of the speakers 104 accordingly.

Accordingly, unlike present surround sound speaker technologies in which each speaker is required to be placed at a designated location typically defined by the manufacturer (i.e., one speaker is designated as the left speaker, another speaker is designated as the right speaker, and so on to receive an audio channel based on their designated location) and connected via an audio/video receiver (AVR), the speakers 104 of the present disclosure can be placed into any location within the intended configuration since the location of each of the speakers 104 is detected wirelessly by the mobile computing device 102 prior to transmission of each designated audio channel being transmitted to a corresponding one of the speakers 104.

Figure 3:
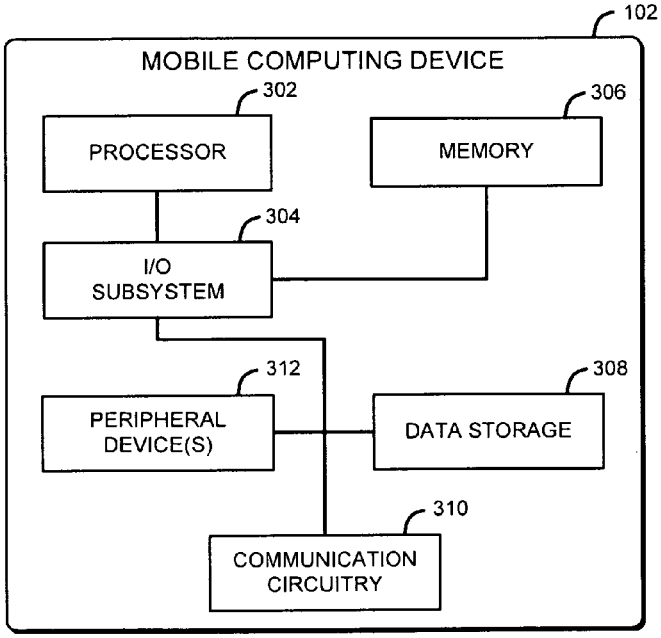
FIG. 3 is a simplified block diagram of at least one embodiment of the mobile computing device the systems of FIGS. 1 and 2.

The mobile computing device 102 may be embodied as any type of computing device that is capable of performing the functions described herein, such as, without limitation, a portable computing device (e.g., smartphone, tablet, laptop, notebook, wearable, etc.) that includes mobile hardware (e.g., processor, memory, storage, wireless communication circuitry, etc.) and software (e.g., an operating system) to support a mobile architecture and portability. As shown in FIG. 3, the illustrative mobile computing device 102 includes a processor 302, an input/output (I/O) subsystem 304, a memory 306, a data storage device 308, communication circuitry 310, and one or more peripheral devices 312. Of course, in other embodiments, the mobile computing device 102 may include other or additional components, such as those commonly found in a computing device. Further, in some embodiments, one or more of the illustrative components may be omitted from the mobile computing device 102. Additionally, in some embodiments, one or more of the illustrative components may be incorporated in, or otherwise form a portion of, another component. For example, the memory 306, or portions thereof, may be incorporated in the processor 302, in some embodiments.

The processor 302 may be embodied as any type of processor capable of performing the functions described herein. For example, the processor 302 may be embodied as a single or multi-core processor(s), digital signal processor, microcontroller, or other processor or processing/controlling circuit. The memory 306 may be embodied as any type of volatile or non-volatile memory or data storage capable of performing the functions described herein. In operation, the memory 306 may store various data and software used during operation of the mobile computing device 102, such as operating systems, applications, programs, libraries, and drivers.

The memory 306 is communicatively coupled to the processor 302 via the I/O subsystem 304, which may be embodied as circuitry and/or components to facilitate input/output operations with the processor 302, the memory 306, and other components of the mobile computing device 102. For example, the I/O subsystem 304 may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations. In some embodiments, the I/O subsystem 304 may form a portion of a system-on-a-chip (SoC) and be incorporated, along with the processor 302, the memory 306, and/or other components of the mobile computing device 102, on a single integrated circuit chip.

The data storage device 308 may be embodied as any type of device or devices configured for short-term or long-term storage of data, such as memory devices and circuits, memory cards, hard disk drives, solid-state drives, or other data storage devices, for example. It should be appreciated that the data storage device 308 and/or the memory 306 (e.g., the computer-readable storage media) may store various types of data capable of being executed by a processor (e.g., the processor 302) of the mobile computing device 102, including operating systems, applications, programs, libraries, drivers, instructions, etc.

The communication circuitry 310 may be embodied as any communication circuit, device, or collection thereof, capable of enabling communications between the mobile computing device 102 and the speakers 104 over a wireless communication channel. For example, the communication circuitry 310 may include a network interface controller (NIC) and/or other devices capable of performing networking-related operations, which are not shown for clarity of the description. The communication circuitry 310 may be configured to use any one or more wireless communication technologies and associated protocols (e.g., Ethernet, Wi-Fi®, Bluetooth®, Bluetooth® Low Energy (BLE), near-field communication (NFC), Worldwide Interoperability for Microwave Access (WiMAX), Digital Living Network Alliance (DLNA), etc.) to affect such communication. The communication circuitry 310 may be additionally configured to use any one or more wireless and/or wired communication technologies and associated protocols to effect communication with other computing devices, such as over a network, for example.

The peripheral devices 312 may include any number of input/output devices, interface devices, and/or other peripheral devices. For example, in some embodiments, the peripheral devices 312 may include a display, a touch screen, graphics circuitry, a keyboard, a mouse, a microphone, a speaker, and/or other input/output devices, interface devices, and/or peripheral devices. The particular devices included in the peripheral devices 312 may depend on, for example, the type and/or intended use of the mobile computing device 102. The peripheral devices 312 may additionally or alternatively include one or more ports, such as a USB port, for example, for connecting external peripheral devices to the mobile computing device 102.

Referring again to FIG. 1, the illustrative speakers 104 include a first speaker (i.e., speaker (1) 106), a second speaker (i.e., speaker (2) 108), a third speaker (i.e., speaker (3) 110), a fourth speaker (i.e., speaker (4) 112), and a fifth speaker (i.e., speaker (5) 114), each of which are positioned (e.g., by a user of the speakers 104) in the speaker configuration of system 100 relative to a display device 118, such as a television. Each of the speakers 104 may be embodied as any type of hardware, firmware, software, or combination thereof configured to convert an electrical audio signal (i.e., an audio stream) into corresponding sound (i.e., provide auditory feedback via sound waves). For example, in some embodiments, each of the speakers 104 may be embodied as a loudspeaker (i.e., an electroacoustic transducer). As such, each of the speakers 104 may include like or similar components to those of the illustrative mobile computing device 102 of FIG. 3. Accordingly, further descriptions of the like components are not repeated herein with the understanding that the description of the corresponding components provided above in regard to the illustrative mobile computing device 102 of FIG. 3 applies equally to the corresponding components of the speakers 104.

Each of the wireless communication channels 116 between the speakers 104 and the mobile computing device 102 may be embodied as any type of wireless interconnect that may be established using any one or more wireless communication technologies and associated protocols, including Ethernet, Wi-Fi®, Bluetooth®, Bluetooth® Low Energy (BLE), near-field communication (NFC), etc. Accordingly, the wireless communication channels 116 are usable by the mobile computing device 102 and the speakers 104 in which to transmit data therebetween, as described below.

Figure 4:
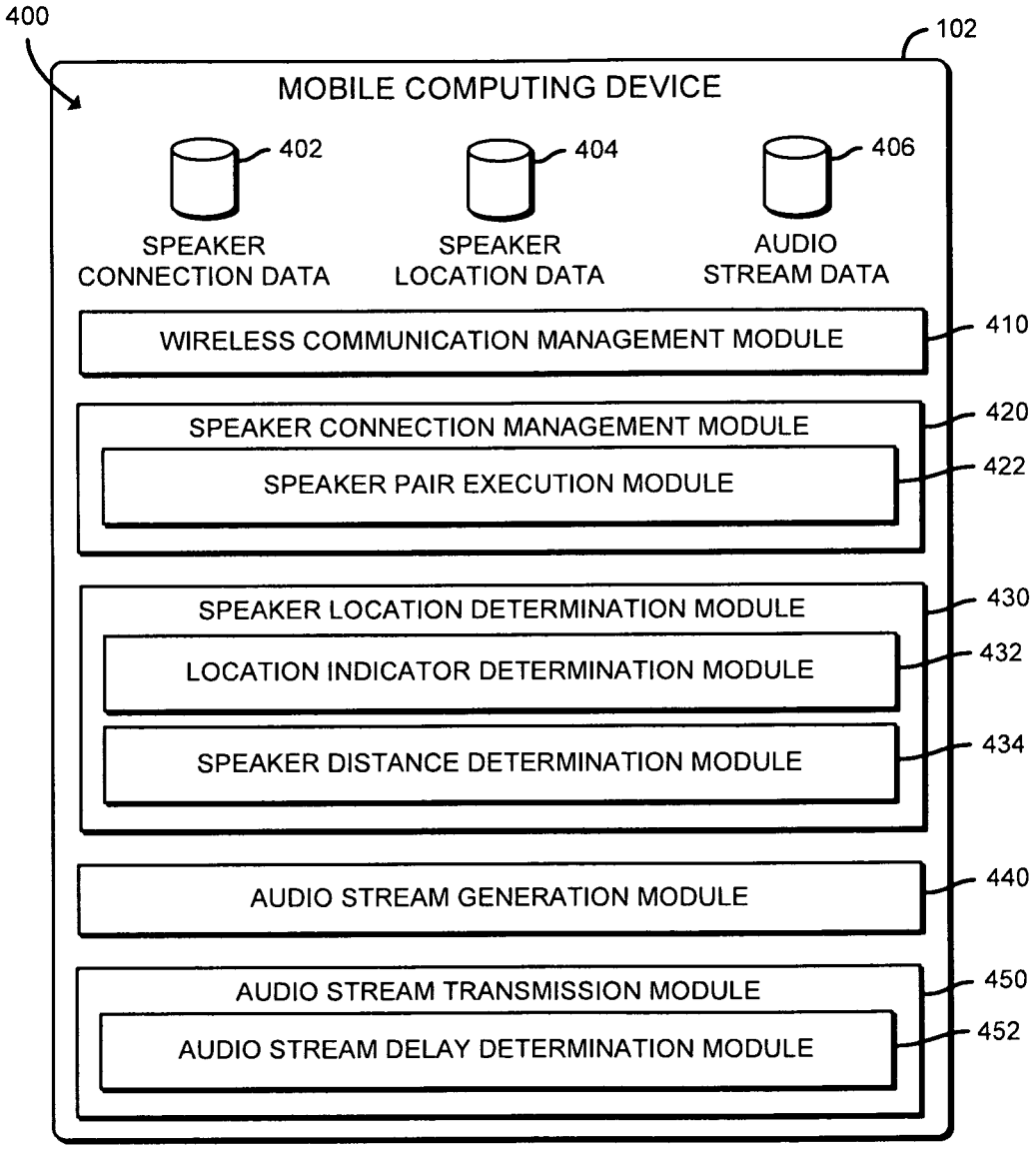
FIG. 4 is a simplified block diagram of at least one embodiment of an environment of the mobile computing device of FIGS. 1-3.

Referring now to FIG. 4, in an illustrative embodiment, the mobile computing device 102 establishes an environment 400 during operation. The illustrative environment 400 includes a wireless communication management module 410, a speaker connection management module 420, a speaker location determination module 430, an audio stream generation module 440, and an audio stream transmission module 450. The various modules of the environment 400 may be embodied as hardware, firmware, software, or a combination thereof. As such, in some embodiments, one or more of the modules of the environment 400 may be embodied as circuitry or collection of electrical devices (e.g., a wireless communication management circuit 410, a speaker connection management circuit 420, a speaker location determination circuit 430, an audio stream generation circuit 440, an audio stream transmission circuit 450, etc.).

It should be appreciated that, in such embodiments, one or more of the wireless communication management circuitry 410, the speaker connection management circuitry 420, a speaker location determination circuitry 430, the audio stream generation circuitry 440, the audio stream transmission circuitry 450 may form a portion of one or more of the processor 302, the I/O subsystem 304, and/or other components of the mobile computing device 102. Additionally, in some embodiments, one or more of the illustrative modules may form a portion of another module and/or one or more of the illustrative modules may be independent of one another. Further, in some embodiments, one or more of the modules of the environment 400 may be embodied as virtualized hardware components or emulated architecture, which may be established and maintained by the processor 302 or other components of the mobile computing device 102.

In the illustrative environment 400, the mobile computing device 102 further includes speaker connection data 402, speaker location data 404, and audio stream data 406, each of which may be stored in the memory 306 and/or the data storage device 308 of the mobile computing device 102. Further, each of the speaker connection data 402, the speaker location data 404, and/or the audio stream data 406 may be accessed by the various modules and/or sub-modules of the mobile computing device 102. It should be appreciated that the mobile computing device 102 may include additional and/or alternative components, sub-components, modules, sub-modules, and/or devices commonly found in a computing device, which are not illustrated in FIG. 4 for clarity of the description.

The wireless communication management module 410, which may be embodied as hardware, firmware, software, virtualized hardware, emulated architecture, and/or a combination thereof as discussed above, is configured to facilitate inbound and outbound wireless network communications (e.g., network traffic, network packets, network flows, etc.) to and from the mobile computing device 102. To do so, the wireless communication management module 410 is configured to receive and process network packets from other computing devices (e.g., the speakers 104). Additionally, the wireless communication management module 410 is configured to prepare and transmit network packets to another computing device (e.g., the speakers 104). To do so, the wireless communication management module 410 is configured to establish communication channels with each of the communicatively coupled computing devices, such as may be established at the network layer (i.e., the IP layer). Accordingly, in some embodiments, at least a portion of the functionality of the wireless communication management module 410 may be performed by the communication circuitry 310 of the mobile computing device 102, or more specifically by a network interface controller (NIC) (not shown) of the communication circuitry 310.

The speaker connection management module 420, which may be embodied as hardware, firmware, software, virtualized hardware, emulated architecture, and/or a combination thereof as discussed above, is configured to manage the connections (i.e., the wireless communication channels 116) between the mobile computing device 102 and the speakers 104. Accordingly, the speaker connection management module 420 is configured to detect the speakers 104 that are in wireless communication proximity to the mobile computing device 102 and connect to the detected speakers 104. It should be appreciated that the wireless communication proximity is predicated upon which wireless communication technology is available and active on the mobile computing device 102 and the speakers 104. To connect to the detected speakers 104, the speaker connection management module 420 is configured to exchange connection information with the speakers. Such connection information may include any data usable to establish the wireless communication channels 116 between the mobile computing device 102 and the speakers 104. For example, the connection information may include an internet protocol (IP) address of the mobile computing device 102, an IP address of the speakers 104, network port numbers, access credentials, session keys, etc. Such connection information may be stored in the speaker connection data 402, such that the connection data may be retrieved and utilized for future connection attempts.

In some embodiments, prior to connection, the speakers 104 may be required to be paired with the mobile computing device 102. Accordingly, the illustrative speaker connection management module 420 includes a speaker pair execution module 422 that is configured to perform the pairing operation. In some embodiments, during the pairing operation, pairing information, such as may be exchanged during a Wi-Fi® setup (e.g., manual entry of connection data, Wi-Fi Protected Setup (WPS), etc.) or Bluetooth® pairing (e.g., bonding) may be collected. Such pairing information may be stored in the speaker connection data 402. During the pairing process, the speaker pair execution module 422 may be further configured to perform a capability exchange to collect audio playback capabilities of the connected speakers 104, such as supported audio codecs. For example, the speaker pair execution module 422 may be configured to transmit a request message to the speaker 104 requesting the audio playback capabilities of the speaker 104 and receive a response message from the speaker 104 that includes the audio playback capabilities of the speaker 104.

The speaker location determination module 430, which may be embodied as hardware, firmware, software, virtualized hardware, emulated architecture, and/or a combination thereof as discussed above, is configured to determine a location of each of the speakers 104 and assign a location indicator to each of the speakers 104. To do so, the illustrative speaker location determination module 430 includes a location indicator determination module 432 and a speaker distance determination module 434. It should be appreciated that each of the location indicator determination module 432 and the speaker distance determination module 434 of the speaker location determination module 430 may be separately embodied as hardware, firmware, software, virtualized hardware, emulated architecture, and/or a combination thereof. For example, the location indicator determination module 432 may be embodied as a hardware component, while the speaker distance determination module 434 is embodied as a virtualized hardware component or as some other combination of hardware, firmware, software, virtualized hardware, emulated architecture, and/or a combination thereof.

The location indicator determination module 432 is configured to determine the location of each of the speakers 104 relative to the mobile computing device 102 and the other speakers 104. To do so, the location indicator determination module 432 may be configured to use any known technology, such as angle of incidence detection technology, Wi-Fi, ultrasound, etc. For example, in a Dolby Surround 5.1 surround sound compatible configuration, each of the speakers 104 can be placed in one of five speaker positions (i.e., each of the speakers 104 can be assigned one of five location indicators) including a left speaker, a center speaker, a right speaker, a left surround speaker, and a right surround speaker, typically relative to the display device 118 and a viewing location (e.g., a couch, a chair, etc.), which is not shown for clarity of the description. Accordingly, in such embodiments (see, e.g., the speaker configuration of the illustrative system 100 of FIG. 1), the location indicator determination module 432 may designate speaker (1) 106 as the left speaker, speaker (2) 108 as the center speaker, speaker (3) 110 as the right speaker, designate speaker (4) 112 as the left surround speaker, and speaker (5) 114 as the right surround speaker. It should be appreciated that the Dolby Surround 5.1 embodiment may additionally include a subwoofer, which is also not shown for clarity of the description.

The speaker distance determination module 434 is configured to determine a distance between the mobile computing device 102 and each of the speakers 104, as well as a distance between one of the speakers 104 and the other speakers 104. It should be appreciated that such distance information may be usable by the location indicator determination module 432 to determine the location indicators. In some embodiments, the location indicators, distance information, and any other location identifying information may be stored in the speaker location data.

It should be appreciated that, in some embodiments, a user may be provided an interface via the mobile computing device 102 that allows the user to modify the location indicators. To do so, the mobile computing device 102 may be configured to list each of the connected speakers 104, list one or more identifiers of each of the connected speakers, and/or allow testing (i.e., emit a test audio stream) of the present speaker configuration to assist the user in matching the location indicators to the appropriate speakers 104. In such embodiments, the speaker location determination module 430 may be additionally configured to update the location indicators assigned to the corresponding speakers 104 based on the modifications received via the interface.

The audio stream generation module 440, which may be embodied as hardware, firmware, software, virtualized hardware, emulated architecture, and/or a combination thereof as discussed above, is configured to generate an audio stream for each audio channel corresponding to the configuration of the speakers 104. To do so, the audio stream generation module 440 is configured to generate a single surround audio stream and split the single surround audio stream into a number of different audio stream channels based on the number of speakers 104 and the location indicator to which each of the speakers 104 has been assigned, such as may be assigned by the location indicator determination module 432. In some embodiments, data related to each audio stream may be stored in the audio stream data 406. The audio stream transmission module 450 is configured to transmit the each of the audio stream channels, such as may be generated by the audio stream generation module 440, to their corresponding speakers 104. To do so, the audio stream transmission module 450 is configured to transmit each of the audio stream channels to a corresponding one of the speakers 104 based on the location indicators assigned to each of the speakers 104.

Figure 5:
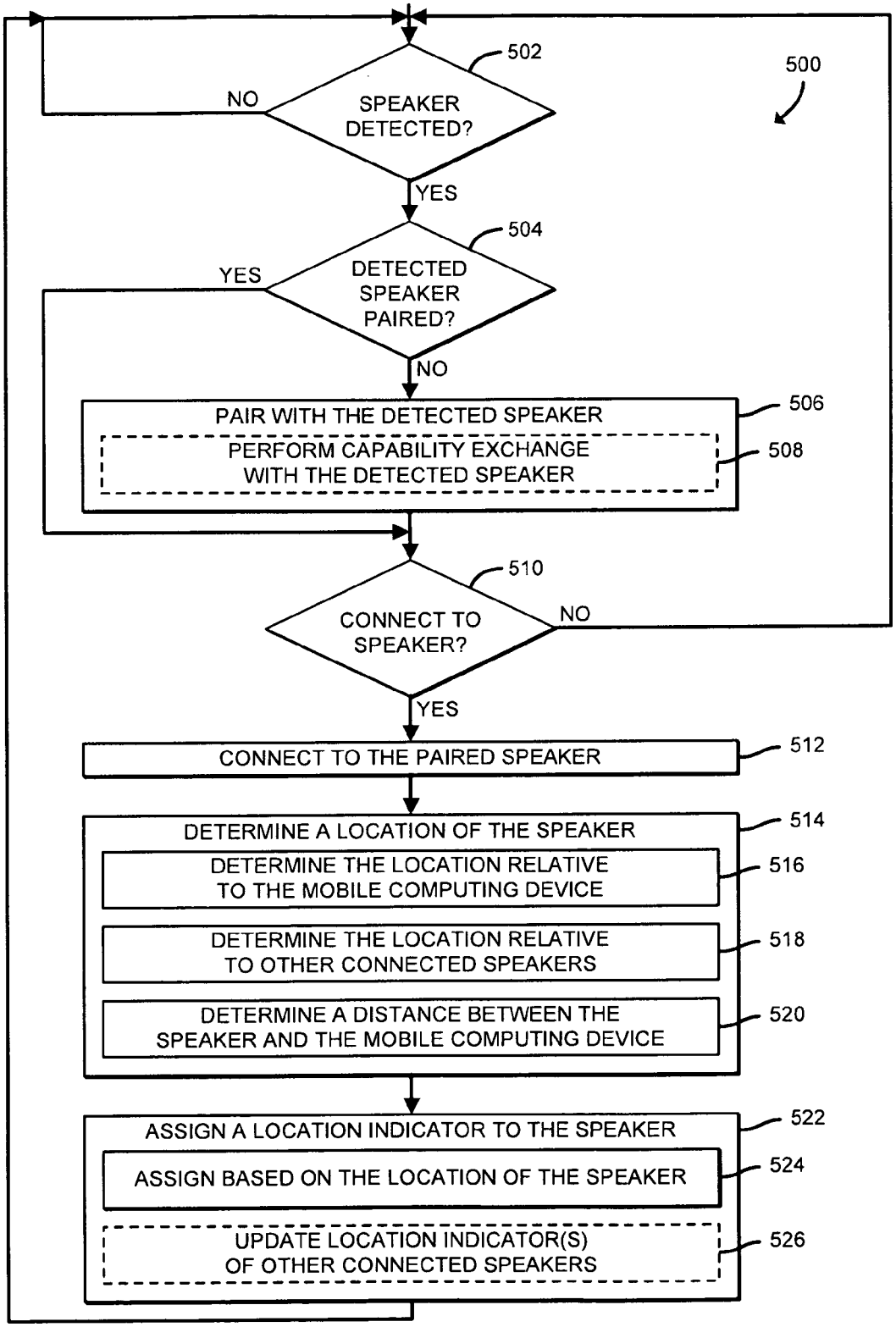
FIG. 5 is a simplified flow diagram of at least one embodiment for connecting to one or more speakers that may be executed by the mobile computing device of FIGS. 1-3.

Referring now to FIG. 5, in use, the mobile computing device 102 may execute a method 500 for connecting to one or more speakers (e.g., the speakers 104). The method 500 begins in block 502, in which the mobile computing device 102 determines whether a speaker that is not presently connected to the mobile computing device 102 has been detected (i.e., is in wireless communication proximity to be detected by the mobile computing device 102). If so, the method 500 advances to block 504, in which the mobile computing device 102 determines whether the detected speaker is paired to the mobile computing device 102.

If so, the method 500 branches to block 510 described below; otherwise, the method 500 advances to block 506, in which the mobile computing device 102 pairs with the detected speaker. In some embodiments, in block 508, the mobile computing device 102 performs a capability exchange with the detected speaker during the paring operation performed in block 506. As described previously, audio playback capabilities, such as supported audio codecs may be collected during the capability exchange. In block 510, the mobile computing device 102 determines whether to connect to the paired speaker. If not, the method 500 loops back to block 502 to determine whether a speaker that is not presently connected to the mobile computing device 102 has been detected. Otherwise, if the mobile computing device 102 determines to connect to the paired speaker, the method 500 advances to block 512, in which the mobile computing device 102 connects to the paired speaker.

In block 514, the mobile computing device 102 determines a location of the speaker. To do so, in block 516, the mobile computing device 102 determines the location of the speaker relative to the mobile computing device 102, such as may be determines using one or more angle of incidence detection technologies. Additionally, in block 518, the mobile computing device 102 determines the location relative other speakers presently connected to the mobile computing device 102. In block 520, the mobile computing device 102 further determines a distance between the speaker and the mobile computing device 102.

In block 522, the mobile computing device 102 assigns a location indicator to the speaker. In block 524, the mobile computing device 102 assigns the location indicator based on the location of the speaker determined in block 514. In some embodiments, in block 526, the mobile computing device 102 updates the location indicator(s) of the other connected speaker(s). In other words, in some embodiments, the location indicator assigned to the speaker may displace a location indicator previously assigned to another speaker.

Figure 6:
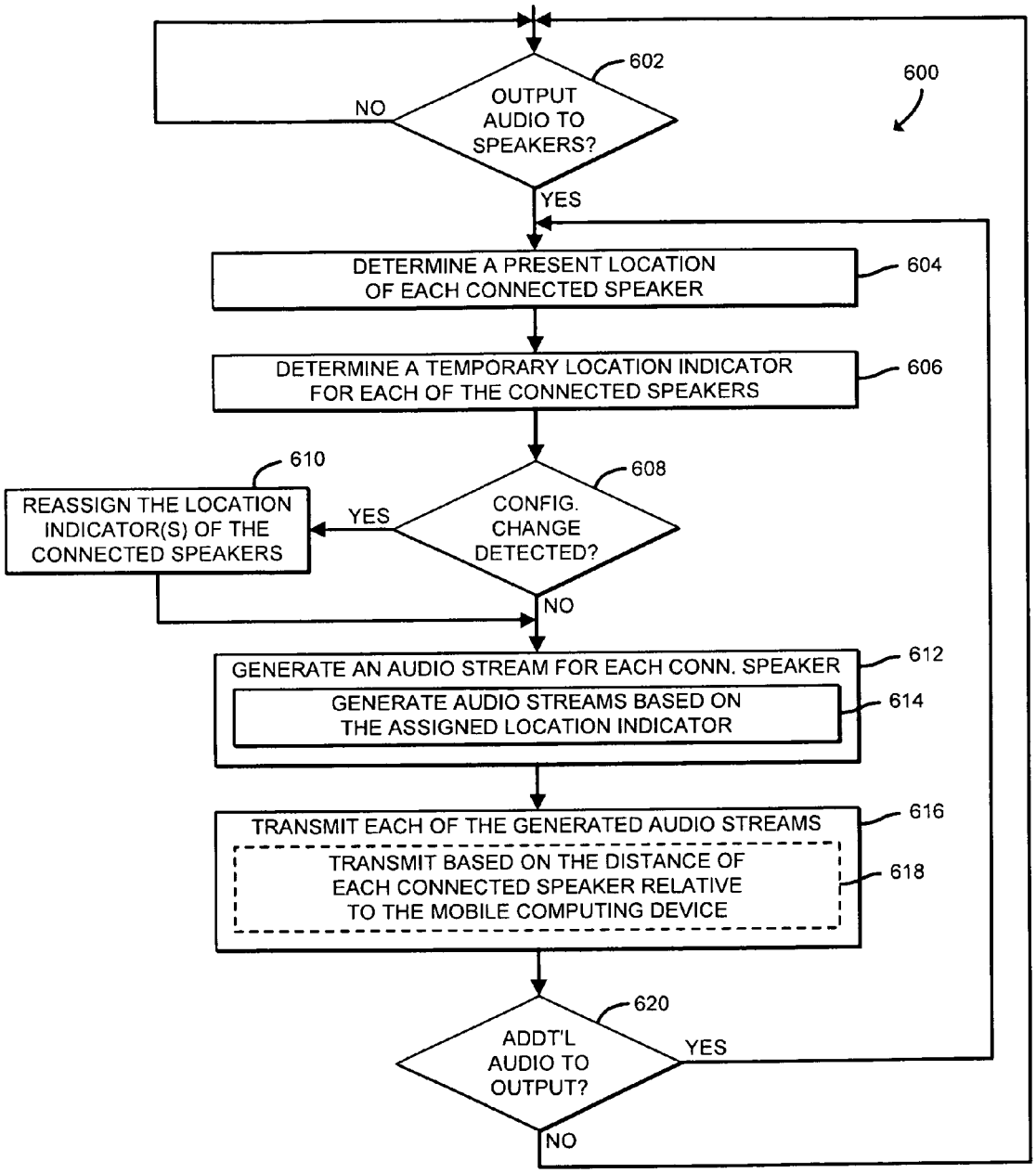
FIG. 6 is a simplified flow diagram of at least one embodiment for facilitating the output of a plurality of audio stream channels that may be executed by the wireless computing device of FIGS. 1-3.

Referring now to FIG. 6, in use, the mobile computing device 102 may execute a method 600 for facilitating the output of multiple audio stream channels to corresponding connected speakers (e.g., the speakers 104 of FIG. 1). Accordingly, it should be appreciated that each of the speakers 104 are presently connected to the mobile computing device 102, such as in the method 500 of FIG. 5 previously described. The method 600 begins in block 602, in which the mobile computing device 102 determines whether audio is to be output to the presently connected speakers. If so, the method 600 advances to block 604, in which the mobile computing device 102 determines a present location for each of the connected speakers 104. As described previously, the present locations may include one or more of locations of each of the speakers 104 relative to the mobile computing device 102, locations of each of the speakers 104 relative to the other speakers 104, and distances between each of the speakers 104 and the mobile computing device 102.

In block 608, the mobile computing device 102 determines whether a configuration change was detected. To do so, the mobile computing device 102 may be configured to compare the temporary location indicator determined for each of the speakers 104 in block 606 to the assigned location indicator, such as may be assigned during connection of the speakers 104 and/or subsequent to a detected configuration change. If a configuration change was detected in block 608, the method 600 branches to block 610, in which the mobile computing device 102 reassigns one or more location indicators of the speakers 104, as necessary, before the method 600 advances to block 612, described below. In other words, not all of the location indicators of the speakers 104 in the configuration may be affected.

Figure 2:
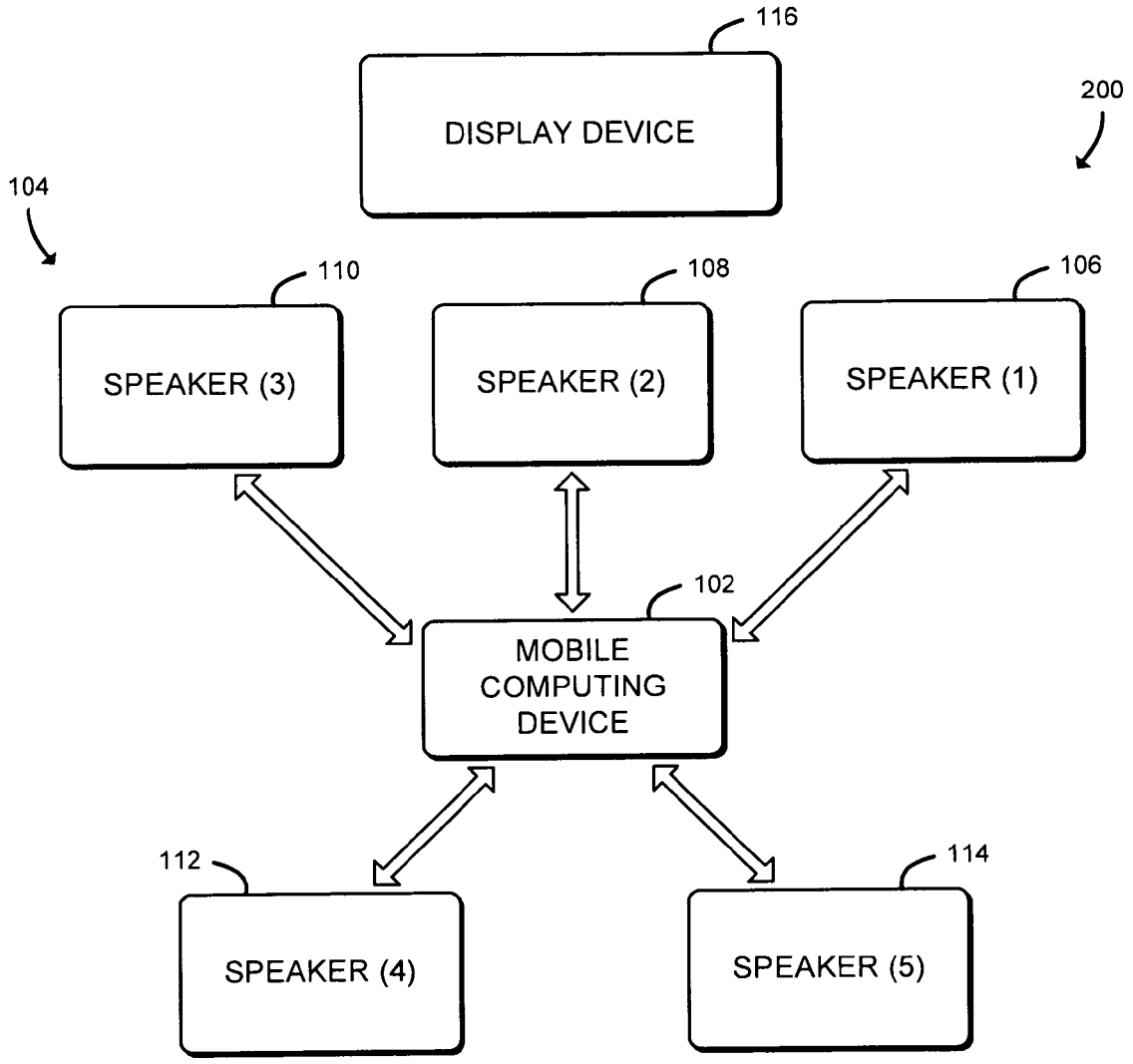
FIG. 2 is a simplified block diagram of at least one alternative embodiment of a system for location-dependent wireless speaker configuration that includes a mobile computing device wirelessly coupled to a plurality of speakers.

For example, as described previously, in the speaker configuration of the illustrative system 100 of FIG. 1, the mobile computing device 102 may designate speaker (1) 106 as the left speaker, speaker (2) 108 as the center speaker, speaker (3) 110 as the right speaker, designate speaker (4) 112 as the left surround speaker, and speaker (5) 114 as the right surround speaker. However, as shown in the speaker configuration of the illustrative system 200 of FIG. 2, the location of speaker (1) 106 and speaker (3) 110 have been reversed as compared to the speaker configuration of the illustrative system 100 of FIG. 1. Unlike tradition surround sound speakers whose location is fixed, the mobile computing device 102 is configured to detect the location change and update the location indicators accordingly.

As a result, the mobile computing device 102 may designate speaker (3) 110 as the left speaker, speaker (2) 108 as the center speaker, speaker (1) 106 as the right speaker, designate speaker (4) 112 as the left surround speaker, and speaker (5) 114 as the right surround speaker. In other words, the mobile computing device 102 is configured to automatically (i.e., without manual user interaction) detect the configuration change and dynamically adjust the location indicators such that the correct audio channels are assigned to the correct speakers 104 (i.e., the expected audio is received and output by the appropriate speakers 104 based on the updated configuration).

Referring again to FIG. 6, if a configuration change was not detected in block 608, the method 600 advances to block 612, in which the mobile computing device 102 generates an audio stream for each connected speaker. To do so, in block 614, the mobile computing device 102 generated a single surround audio stream and splits the single surround audio stream into different audio stream channels based on the assigned location indicator. In block 616, the mobile computing device 102 transmits each of the audio streams to their respective speakers 104. In other words, each of the speakers 104 is assigned a different audio stream channel corresponding to their assigned location indicator, from which each audio stream channel is routed to a corresponding one of the speakers 104 based on the location indicators assigned to each of the speakers 104.

Additionally, in some embodiments, in block 618, the mobile computing device 102 transmits each of the generated audio streams based on the distance of each connected speaker relative to the mobile computing device 102. In other words, the mobile computing device 102 may be configured to calculate a delay based on the distance between one or more of the speakers 104 and the other speakers 104 relative to the mobile computing device 102, and transmit the generated audio streams based on the calculated delay. As such, playback out each of the speakers 104 can reach the ears of a listener (e.g., near to, wearing, carrying, or otherwise holding the mobile computing device 102) in a synchronized manner, even though the listener (i.e., the mobile computing device 102) is closer to one or more of the speakers 104 than the other speakers 104.

In block 620, the mobile computing device 102 determines whether additional audio is to be output from the mobile computing device 102 to the speakers 104. If so, the method 600 returns to block 604 to again determine the present location of each of the connected speakers 104 (i.e., to detect whether a configuration change occurred); otherwise, the method 600 return to block 602 to determine whether another audio stream is to be output to the speakers 104.

It should be appreciated that at least a portion of the methods 500 and 600 may be embodied as various instructions stored on a computer-readable media, which may be executed by the processor 302, the communication circuitry 310, and/or other components of the mobile computing device 102 to cause the mobile computing device 102 to perform the methods 500 and 600. The computer-readable media may be embodied as any type of media capable of being read by the mobile computing device 102 including, but not limited to, the memory 306, the data storage device 308, a local memory of a NIC (not shown) of the communication circuitry 310, other memory or data storage devices of the mobile computing device 102, portable media readable by a peripheral device of the mobile computing device 102, and/or other media.

EXAMPLES

Illustrative examples of the technologies disclosed herein are provided below. An embodiment of the technologies may include any one or more, and any combination of, the examples described below.

Example 1 includes a mobile computing device for location-dependent wireless speaker configuration, the mobile computing device comprising a speaker location determination module to (i) determine a location of each of a plurality of speakers wirelessly coupled to the mobile computing device and (ii) assign a location indicator to each of the speakers based on the determined location of each of the speakers, wherein the location indicator identifies the location of each one of the speakers relative to the other speakers of the plurality of speakers; an audio stream generation module to generate an audio stream for each of the speakers based on the assigned location indicator; and an audio stream transmission module to transmit each of the generated audio streams to a corresponding one of the speakers.

Example 2 includes the subject matter of Example 1, and wherein to determine the location of each of the speakers comprises to determine the location of each of the speakers relative to the location of the mobile computing device.

Example 3 includes the subject matter of any of Examples 1 and 2, and wherein to determine the location of each of the speakers comprises to determine the location of each of the speakers relative to the location of each of the other speakers.

Example 4 includes the subject matter of any of Examples 1-3, and wherein to determine the location of each of the speakers comprises to determine a distance between each of the speakers and the mobile computing device.

Example 5 includes the subject matter of any of Examples 1-4, and wherein the audio stream transmission module is further configured to determine a delay of one or more of the generated audio streams based on the determined distance between each of the speakers and the mobile computing device, and wherein to transmit each of the generated audio streams to the corresponding speakers comprises to transmit one or more of the generated audio streams based on the determined delay.

Example 6 includes the subject matter of any of Examples 1-5, and wherein the speaker location determination module is further to (i) determine an updated location of the speakers, (ii) determine a temporary location indicator for each of the speakers based on the determine updated locations, (iii) compare each of the temporary location indicators to the corresponding assigned location indicators to determine whether a configuration change was detected, and (iv) update, in response to a determination that the configuration change was detected, the assigned location indicators of one or more speakers determined to have caused the detected configuration change.

Example 7 includes the subject matter of any of Examples 1-6, and further including a speaker connection management module to connect the mobile computing device to each of the detected speakers.

Example 8 includes the subject matter of any of Examples 1-7, and wherein the speaker connection management module is further to perform a pair operation to pair the mobile computing device and each of the connected speakers.

Example 9 includes the subject matter of any of Examples 1-8, and wherein the speaker connection management module is further to (i) perform a capability exchange during the pair operation and (ii) determine one or more audio support capabilities based on the capability exchange.

Example 10 includes the subject matter of any of Examples 1-9, and wherein the speaker location determination module is further to (i) provide an interface to the user to indicate which of the location indicators are assigned to each of the speakers, (ii) prompt the user to change one or more of the location indicators assigned to a corresponding one or more of the speakers, and (iii) assign, in response to a determination that the user changed one or more of the location indicators, updated location indicators to each of the corresponding one or more speakers.

Example 11 includes a method for location-dependent wireless speaker configuration, the method comprising determining, by a mobile computing device, a location of each of a plurality of speakers wirelessly coupled to the mobile computing device; assigning, by the mobile computing device, a location indicator to each of the speakers based on the determined location of each of the speakers, wherein the location indicator identifies the location of each one of the speakers relative to the other speakers of the plurality of speakers; generating, by the mobile computing device, an audio stream for each of the speakers based on the assigned location indicator; and transmitting, by the mobile computing device, each of the generated audio streams to a corresponding one of the speakers.

Example 12 includes the subject matter of Example 11, and wherein determining the location of each of the speakers comprises determining the location of each of the speakers relative to the location of the mobile computing device.

Example 13 includes the subject matter of any of Examples 11 and 12, and wherein determining the location of each of the speakers comprises determining the location of each of the speakers relative to the location of each of the other speakers.

Example 14 includes the subject matter of any of Examples 11-13, and wherein determining the location of each of the speakers comprises determining a distance between each of the speakers and the mobile computing device.

Example 15 includes the subject matter of any of Examples 11-14, and further including determining, by the mobile computing device, a delay of one or more of the generated audio streams based on the determined distance between each of the speakers and the mobile computing device, and wherein transmitting each of the generated audio streams to the corresponding speakers comprises transmitting one or more of the generated audio streams based on the determined delay.

Example 16 includes the subject matter of any of Examples 11-15, and further including determining, by the mobile computing device, an updated location of the speakers; determining, by the mobile computing device, a temporary location indicator for each of the speakers based on the determine updated locations; comparing, by the mobile computing device, each of the temporary location indicators to the corresponding assigned location indicators to determine whether a configuration change was detected; and updating, by the mobile computing device and in response to a determination that the configuration change was detected, the assigned location indicators of one or more speakers determined to have caused the detected configuration change.

Example 17 includes the subject matter of any of Examples 11-16, and further including connecting, by the mobile computing device, the mobile computing device to each of the detected speakers.

Example 18 includes the subject matter of any of Examples 11-17, and further including performing, by the mobile computing device, a pair operation to pair the mobile computing device and each of the connected speakers.

Example 19 includes the subject matter of any of Examples 11-18, and further including performing, by the mobile computing device, a capability exchange during the pair operation; and determining, by the mobile computing device, one or more audio support capabilities based on the capability exchange.

Example 20 includes the subject matter of any of Examples 11-19, and further including providing, by the mobile computing device, an interface to the user to indicate which of the location indicators are assigned to each of the speakers; prompting, by the mobile computing device, the user to change one or more of the location indicators assigned to a corresponding one or more of the speakers; assigning, by the mobile computing device and in response to a determination that the user changed one or more of the location indicators, updated location indicators to each of the corresponding one or more speakers.

Example 21 includes a mobile computing device comprising a processor; and a memory having stored therein a plurality of instructions that when executed by the processor cause the mobile computing device to perform the method of any of Examples 11-20.

Example 22 includes one or more machine readable storage media comprising a plurality of instructions stored thereon that in response to being executed result in a mobile computing device performing the method of any of Examples 11-20.

Example 23 includes a mobile computing device for location-dependent wireless speaker configuration, the mobile computing device comprising means for determining a location of each of a plurality of speakers wirelessly coupled to the mobile computing device; means for assigning a location indicator to each of the speakers based on the determined location of each of the speakers, wherein the location indicator identifies the location of each one of the speakers relative to the other speakers of the plurality of speakers; means for generating an audio stream for each of the speakers based on the assigned location indicator; and means for transmitting each of the generated audio streams to a corresponding one of the speakers.

Example 24 includes the subject matter of Example 23, and wherein the means for determining the location of each of the speakers comprises means for determining the location of each of the speakers relative to the location of the mobile computing device.

Example 25 includes the subject matter of any of Examples 23 and 24, and wherein the means for determining the location of each of the speakers comprises means for determining the location of each of the speakers relative to the location of each of the other speakers.

Example 26 includes the subject matter of any of Examples 23-25, and wherein the means for determining the location of each of the speakers comprises means for determining a distance between each of the speakers and the mobile computing device.

Example 27 includes the subject matter of any of Examples 23-26, and further including means for determining a delay of one or more of the generated audio streams based on the determined distance between each of the speakers and the mobile computing device, and wherein the means for transmitting each of the generated audio streams to the corresponding speakers comprises means for transmitting one or more of the generated audio streams based on the determined delay.

Example 28 includes the subject matter of any of Examples 23-27, and further including means for determining an updated location of the speakers; means for determining a temporary location indicator for each of the speakers based on the determine updated locations; means for comparing each of the temporary location indicators to the corresponding assigned location indicators to determine whether a configuration change was detected; and means for updating, in response to a determination that the configuration change was detected, the assigned location indicators of one or more speakers determined to have caused the detected configuration change.

Example 29 includes the subject matter of any of Examples 23-28, and further including means for connecting the mobile computing device to each of the detected speakers.

Example 30 includes the subject matter of any of Examples 23-29, and further including means for performing a pair operation to pair the mobile computing device and each of the connected speakers.

Example 31 includes the subject matter of any of Examples 23-30, and further including means for performing a capability exchange during the pair operation; and means for determining one or more audio support capabilities based on the capability exchange.

Example 32 includes the subject matter of any of Examples 23-31, and further including means for providing an interface to the user to indicate which of the location indicators are assigned to each of the speakers; means for prompting the user to change one or more of the location indicators assigned to a corresponding one or more of the speakers; means for assigning, in response to a determination that the user changed one or more of the location indicators, updated location indicators to each of the corresponding one or more speakers.

The invention claimed is:

1. A mobile computing device for location-dependent wireless speaker configuration, the mobile computing device comprising:

a speaker location determination module to (i) determine a location of each of a plurality of speakers wirelessly coupled to the mobile computing device relative to the location of the mobile computing device and to the other speakers, and (ii) assign a location indicator to each of the speakers based on the determined location of each of the speakers, wherein the location indicator identifies the location of each one of the speakers relative to the other speakers of the plurality of speakers;

an audio stream generation module to generate an audio stream for each of the speakers based on the assigned location indicator; and an audio stream transmission module to transmit each of the generated audio streams to a corresponding one of the speakers.

2. The mobile computing device of claim 1, wherein to determine the location of each of the speakers comprises to determine a distance between each of the speakers and the mobile computing device.

3. The mobile computing device of claim 2, wherein the audio stream transmission module is further configured to determine a delay of one or more of the generated audio streams based on the determined distance between each of the speakers and the mobile computing device, and wherein to transmit each of the generated audio streams to the corresponding speakers comprises to transmit one or more of the generated audio streams based on the determined delay.

4. The mobile computing device of claim 1, wherein the speaker location determination module is further to (i) determine an updated location of the speakers, (ii) determine a temporary location indicator for each of the speakers based on the determined updated locations, (iii) compare each of the temporary location indicators to the corresponding assigned location indicators to determine whether a configuration change was detected, and (iv) update, in response to a determination that the configuration change was detected, the assigned location indicators of one or more speakers determined to have caused the detected configuration change.

5. The mobile computing device of claim 1, further comprising a speaker connection management module to connect the mobile computing device to each of the detected speakers.

6. The mobile computing device of claim 5, wherein the speaker connection management module is further to perform a pair operation to pair the mobile computing device and each of the connected speakers.

7. The mobile computing device of claim 6, wherein the speaker connection management module is further to (i) perform a capability exchange during the pair operation and (ii) determine one or more audio support capabilities based on the capability exchange.

8. One or more non-transitory, machine-readable storage media comprising a plurality of instructions stored thereon that, in response to execution by a mobile computing device, cause the mobile computing device to:

determine a location of each of a plurality of speakers wirelessly coupled to the mobile computing device relative to the location of the mobile computing device and to the other speakers;

assign a location indicator to each of the speakers based on the determined location of each of the speakers, wherein the location indicator identifies the location of each one of the speakers relative to the other speakers of the plurality of speakers;

generate an audio stream for each of the speakers based on the assigned location indicator; and transmit each of the generated audio streams to a corresponding one of the speakers.

9. The one or more non-transitory, machine-readable storage media of claim 8, wherein to determine the location of each of the speakers comprises to determine a distance between each of the speakers and the mobile computing device.

10. The one or more non-transitory, machine-readable storage media of claim 9, wherein the plurality of instructions further cause the mobile computing device to determine a delay of one or more of the generated audio streams based on the determined distance between each of the speakers and the mobile computing device, and wherein to transmit each of the generated audio streams to the corresponding speakers comprises to transmit one or more of the generated audio streams based on the determined delay.

11. The one or more non-transitory, machine-readable storage media of claim 8, wherein the plurality of instructions further cause the mobile computing device to:

determine an updated location of the speakers;

determine a temporary location indicator for each of the speakers based on the determined updated locations;

compare each of the temporary location indicators to the corresponding assigned location indicators to determine whether a configuration change was detected; and update, in response to a determination that the configuration change was detected, the assigned location indicators of one or more speakers determined to have caused the detected configuration change.

12. The one or more non-transitory, machine-readable storage media of claim 8, wherein the plurality of instructions further cause the mobile computing device to connect the mobile computing device to each of the detected speakers.

13. The one or more non-transitory, machine-readable storage media of claim 12, wherein the plurality of instructions further cause the mobile computing device to perform a pair operation to pair the mobile computing device and each of the connected speakers.

14. The one or more non-transitory, machine-readable storage media of claim 13, wherein the plurality of instructions further cause the mobile computing device to:

perform a capability exchange during the pair operation; and determine one or more audio support capabilities based on the capability exchange.

15. A method for location-dependent wireless speaker configuration, the method comprising:

determining, by a mobile computing device, a location of each of a plurality of speakers wirelessly coupled to the mobile computing device relative to the location of the mobile computing device and to the other speakers;

assigning, by the mobile computing device, a location indicator to each of the speakers based on the determined location of each of the speakers, wherein the location indicator identifies the location of each one of the speakers relative to the other speakers of the plurality of speakers;

generating, by the mobile computing device, an audio stream for each of the speakers based on the assigned location indicator; and transmitting, by the mobile computing device, each of the generated audio streams to a corresponding one of the speakers.

16. The method of claim 15, wherein determining the location of each of the speakers comprises determining a distance between each of the speakers and the mobile computing device.

17. The method of claim 16, further comprising determining, by the mobile computing device, a delay of one or more of the generated audio streams based on the determined distance between each of the speakers and the mobile computing device, and wherein transmitting each of the generated audio streams to the corresponding speakers comprises transmitting one or more of the generated audio streams based on the determined delay.

18. The method of claim 15, further comprising:

determining, by the mobile computing device, an updated location of the speakers;

determining, by the mobile computing device, a temporary location indicator for each of the speakers based on the determined updated locations;

comparing, by the mobile computing device, each of the temporary location indicators to the corresponding assigned location indicators to determine whether a configuration change was detected; and updating, by the mobile computing device and in response to a determination that the configuration change was detected, the assigned location indicators of one or more speakers determined to have caused the detected configuration change.

19. The method of claim 15, further comprising:

connecting, by the mobile computing device, the mobile computing device to each of the detected speakers;

performing, by the mobile computing device, a pair operation to pair the mobile computing device and each of the connected speakers;

performing, by the mobile computing device, a capability exchange during the pair operation; and determining, by the mobile computing device, one or more audio support capabilities based on the capability exchange.

* * * * *